US010035570B1

(12) United States Patent
Barron

(10) Patent No.: US 10,035,570 B1
(45) Date of Patent: Jul. 31, 2018

(54) WATER PROPULSION WATER RESCUE BOARD

(71) Applicant: Inigo Barron, Barcelona (ES)

(72) Inventor: Inigo Barron, Barcelona (ES)

(73) Assignee: Jetson Lithium-Ion Electric Powered Surf & Rescue Boards, Inc., Indialantic, FL (US)

( * ) Notice: Subject to any disclaimer, the term of this patent is extended or adjusted under 35 U.S.C. 154(b) by 0 days.

(21) Appl. No.: 15/484,648

(22) Filed: Apr. 11, 2017

(51) Int. Cl.

| | |
|---|---|
| ***B63B 35/79*** | (2006.01) |
| ***B63H 21/17*** | (2006.01) |
| ***B63H 11/02*** | (2006.01) |
| ***B63C 9/02*** | (2006.01) |

(52) U.S. Cl.
CPC ..... *B63B 35/7943* (2013.01); *B63B 35/7926* (2013.01); *B63C 9/02* (2013.01); *B63H 11/02* (2013.01); *B63H 21/17* (2013.01); *B63B 2755/00* (2013.01)

(58) Field of Classification Search
CPC ..... B63B 35/79; B63B 35/7943; B63B 35/81; B63B 35/83; B63H 21/17; B63H 11/01; B63H 11/02; B63H 11/04; B63H 21/21; A63C 5/03
USPC ..... 114/55.5, 55.56; 441/65, 75, 74
See application file for complete search history.

(56) References Cited

U.S. PATENT DOCUMENTS

| | | | | |
|---|---|---|---|---|
| 4,020,728 | A | 5/1977 | Robinson et al. | |
| 5,017,166 | A | 5/1991 | Chang | |
| 6,142,840 | A | 11/2000 | Efthymiou | |
| 6,409,560 | B1 | 6/2002 | Austin | |
| 6,568,340 | B2 | 5/2003 | Dec et al. | |
| 6,702,634 | B2 | 3/2004 | Jung | |
| 6,901,872 | B1 | 6/2005 | Battle et al. | |
| 6,966,808 | B1 * | 11/2005 | Liao | B63B 35/7943 441/74 |
| 7,226,329 | B2 | 6/2007 | Rainey | |
| 7,731,555 | B2 | 6/2010 | Railey | |
| 7,993,178 | B2 | 8/2011 | Railey | |
| 8,480,447 | B2 * | 7/2013 | Railey | B63B 35/7943 441/74 |
| 8,851,947 | B2 * | 10/2014 | Vlock | B63B 35/7943 441/74 |
| 9,326,181 | B2 | 4/2016 | La Faucheur | |
| 9,718,521 | B2 * | 8/2017 | Derrah | B63B 35/7943 |

(Continued)

*Primary Examiner* — Lars A Olson
(74) *Attorney, Agent, or Firm* — Phyllis K Wood; PK Wood Law Office

(57) ABSTRACT

A water propulsion water rescue board with an integrated water propulsion jet to provide additional thrust for rescue maneuvers and different selectable thrust levels as needed during the maneuver. The water propulsion water rescue board includes a body having an upper surface and bottom surface, a length between nine feet and eleven feet from nose to tail, a thickness between 3.5 and 6 inches, and a water propulsion system integrated into the body including a water inlet on the bottom surface, and a water propulsion nozzle and propeller on the upper surface. An electric motor connects to rotate propeller for drawing water into the propulsion system and expels a pressurized column of water through the water propulsion nozzle. A removable rechargeable battery is connected with the electric motor and a controller with a user control pad on the top surface of the body to allow the user to control the operation of the water propulsion system.

18 Claims, 10 Drawing Sheets

(56) References Cited

U.S. PATENT DOCUMENTS

| | | | |
|---|---|---|---|
| 2003/0167991 | A1 | 9/2003 | Namanny |
| 2016/0068239 | A1 | 3/2016 | Rainey |

* cited by examiner

WATER PROPULSION WATER RESCUE BOARD

FIELD OF THE INVENTION

This invention relates to emergency rescue equipment and, in particular, to methods, systems and devices for an electro-mechanical water propulsion water rescue board for lifeguard water rescue of individuals in distress.

BACKGROUND OF THE INVENTION

Emergency rescue watercraft include inflatable water rescue sled that is fully inflatable, it is lightweight and portable, both inflated and deflated. It is easy to be paddled, pulled by hand, or towed by a jet ski, boat or small hovercraft. The flat bottom makes it exceptionally stable and suitable for use in very shallow water (from only 2"), making it perfect for help in flood rescue.

Jet skis have been used for water rescue and can be used in combination with a rescue sled pulled by the jet ski as described in U.S. Pat. No. 9,376,181. The rescue sleds are designed for ocean, swiftwater and ice rescue where a towed board is essential. A problem with use of a jet ski for emergency water rescue is the time required to move the jet ski to the water's edge, then push the jet ski far enough out to start the motor.

The most commonly used emergency rescue watercraft is the rescue board that has a design similar to a surfboard. Rescue boards are designed for use by lifeguards and have a length suitable for supporting the lifeguard and the person being rescued. These boards often feature bright distinctive "Rescue" colors, big soft easy grab handles, and a flexible center fin. The rescue board has great flotation for fast paddling in water emergency situations. While the rescue board is a low cost solution, a problem with the water rescue board is the time required for the lifeguard to paddle to the victim, often wasting precious time.

Relevant prior art patents include U.S. Pat. No. 7,226,329 which describes a powered surfboard with a maximum thickness of three inches or less and no protruding parts other than fins extending from a rear, bottom portion of the surfboard. The motorized surfboard is configured to perform in substantially the same manner as a traditional surfboard and is unaffected by the presence of a motor other than the improved performance by the thrust provided. Further provided is a motorized surfboard configured with an electric motor of the type used in toy boats and planes. The motor may be controlled by signals from a throttle embedded in the surfboard and which may be hand controlled by a rider of the surfboard. The propulsion system includes a battery powered pump and impellers to provide thrust to move the board through the water. Prior art related to the '329 patent include, but are not limited to U.S. Pat. Nos. 7,731,555; 7,993,178; and 8,480,447 and Pub. 2016/0068239.

U.S. Pat. No. 4,020,728 describes a surfboard which is convertible from unpowered to motorized condition by the selective movement of a motor mounted in the elongated buoyant float member. Hand grip elements and a windshield are detachably connectable to the float member for use by the surfboard rider in a prone position during motorized operation.

Another motorized surfboard is U.S. Pat. No. 5,017,166 which describes a power-driven surfboard, with a D.C. power supply connected between a motor and a pressure-controlled power switch, which is controlled by a pressure board mounted on the top face to drive the motor to operate, and a propeller connected to the motor through a transmission shaft. Once the pressure board is stepped on, the DC power supply is connected to provide the motor with necessary working voltage so as to drive the propeller to propel the surfboard to move forward on water surface.

U.S. Pat. No. 6,409,560 describes motorized surfboard device for propelling a surfboard having a user through water. A motor housing is attached to the bottom surface of the board. A drive motor is positioned in the housing, a propeller is mechanically coupled to the drive motor and a power supply is coupled to the drive motor and positioned in the motor housing.

U.S. Pat. No. 6,702,634 describes a motorized surfboard that can be ridden by a rider which includes a motor and a rotatable propeller, and a control apparatus having at least one of a foot-controlled switch, a hand-operated and controlled steering column, and a hand controlled switch. The control apparatus controlling at least one of on/off operation of the motor and variable speed of the motor.

Other patents include U.S. Pat. Nos. 6,142,840; 6,568,340; 6,901,872; and U.S. Patent Pub. 2003/0167991.

BRIEF SUMMARY OF THE INVENTION

The present invention overcomes the problems outlined above and advances the art by providing an improved water propulsion water rescue board.

A first objective of the invention provides a water propulsion water rescue board with a jet that has enough thrust to allow the lifesaver to arrive faster to the victim shortening the rescue time and allowing the lifesaver to be in better physical and mental condition for the lifesaver maneuver.

A second objective of the present invention provides a water propulsion water rescue board with one or more removable fins that allows the board to be easily stowed when not in use and to be transported without the threat of damage to the fin.

A third objective of the present invention provides a water propulsion water rescue board with a control panel to allow the lifesaver to select up to four different thrust levels for the jets and has indicators showing the battery management and temperature level.

A fourth objective of the present invention provides a water propulsion water rescue board has a larger upper surface with one set of straps for use by the lifeguard and a second, separate, set of straps for use by the rescued victim, making them perfect for emergency evacuation and flood rescue situations.

A fifth objective of the present invention provides a water propulsion water rescue board with a rechargeable lithium ion battery to optimize low weight and provide extra water propulsion for the fastest response in emergency situations.

A sixth objective of the present invention provides a water propulsion water rescue board with a propulsion system that includes a propeller and a nozzle with vanes to optimize the flow and enhance the thrust.

Further objects and advantages of this invention will be apparent from the following detailed description of preferred embodiments which are illustrated schematically in the accompanying drawings.

DETAILED DESCRIPTION OF THE INVENTION

Figure 1:
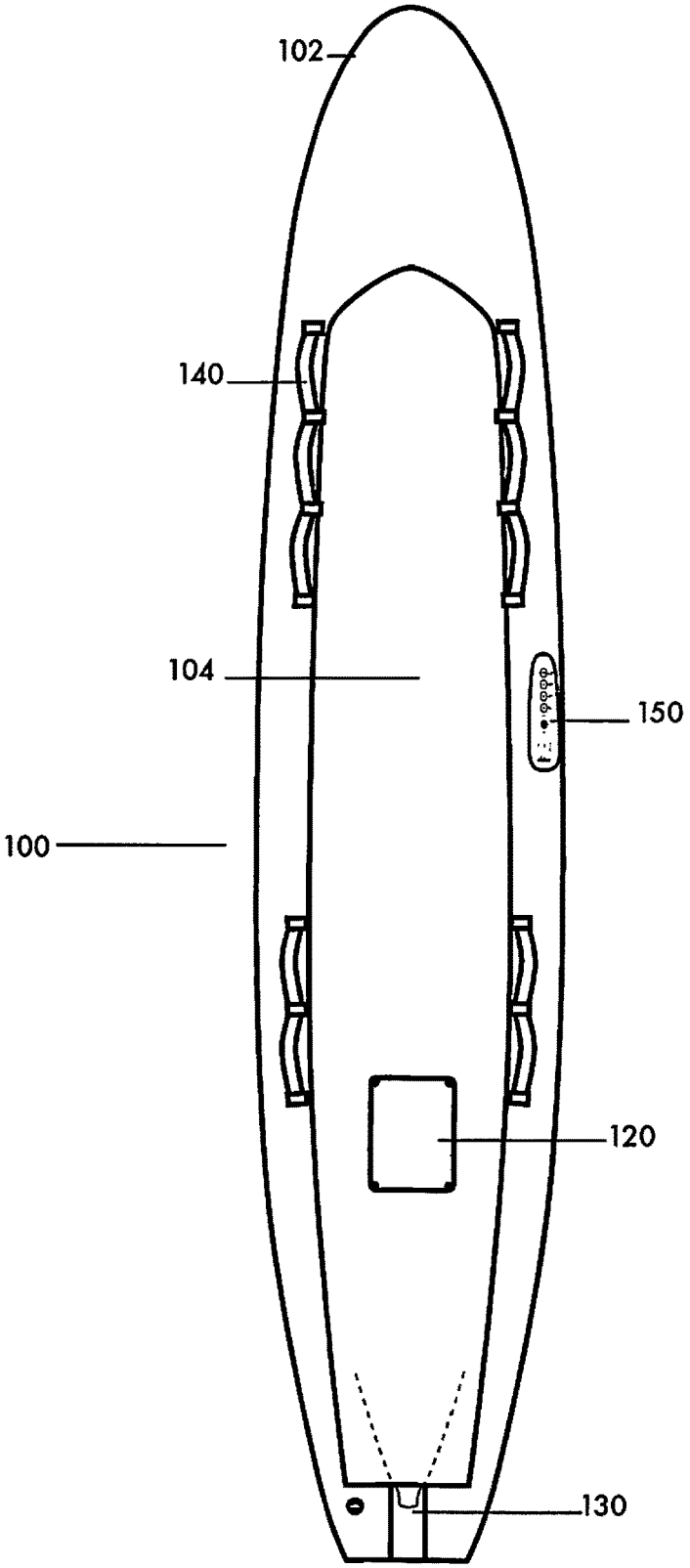
FIG. 1 is a is a top view of the water propulsion water rescue board according to an embodiment of the present invention.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of the reference numbers used in the drawings and the detailed specification to identify components:

100 water propulsion rescue board
102 top surface
104 pad
106 bottom surface
120 battery compartment access panel
122 fasteners
124 fastening tool
125 battery
130 water propulsion nozzle
132 vane
134 propeller
136 housing
138 water jet channel
140 straps
150 control panel
152 propulsion mode selection switches
154 stop/start switch
156 operation indicators
160 water inlet grid
170 motor compartment
190 fin attachment It would be useful to discuss the meanings of some words used herein and their applications before discussing the water propulsion water rescue board invention including:

The terms lifeguard, lifesaver and rescue personnel are used interchangeably.

Deck: The upper surface of the board

Fin or Fins: Fin-shaped inserts on the underside of the back of the board that enable the board to be steered Nose: The forward tip of the board Rails: The side edges of the surfboard Tail: The back end of the board FIG. 1 is a is a top view of the water propulsion water rescue board 100 according to an embodiment of the present invention. The water propulsion water jet has enough thrust to allow the lifeguard to arrive faster to the victim, shortening the rescue time and allowing the lifeguard to be in a better physical and mental condition for the lifesaving maneuver. The water propulsion water rescue board has a larger upper surface with one set of straps for use by the lifeguard and a second, separate, set of straps for use by the rescued victim, making them perfect for emergency evacuation and flood rescue situations.

The water propulsion water rescue board 100 has an overall board length in the range of 8 feet to 11 feet to accommodate both the lifeguard and the person in distress that is being rescued and a width within the range of 22 to 26 inches and a volume of at least 150 liters (5.279 cubic feet). A thickness in the range of approximately 3.3 inches to approximately 6 inches is necessary house the water propulsion system and to provide the volume rigidity required to transport two persons to shore. In a preferred embodiment, the water propulsion water rescue board has a length of approximately 10 foot 2 inches, a width of approximately 26 inches, and a thickness of approximately 3.50 inches or more with a weight of approximately 28.6 lbs with the battery installed (approximately 24.16 lbs without the battery installed).

Figure 8:
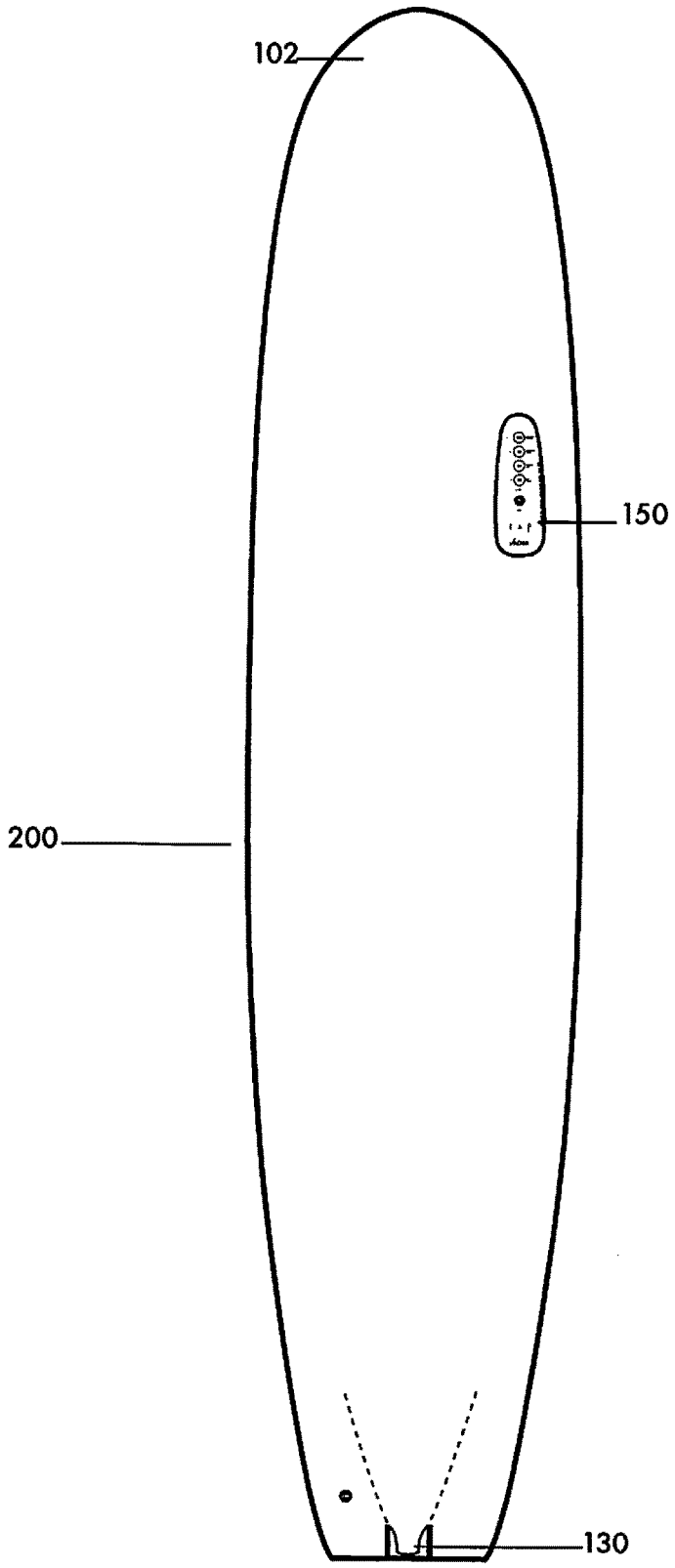
FIG. 8 is a is a top view of the motorized water propulsion water recreation board according to another embodiment of the present invention.
Figure 10A:
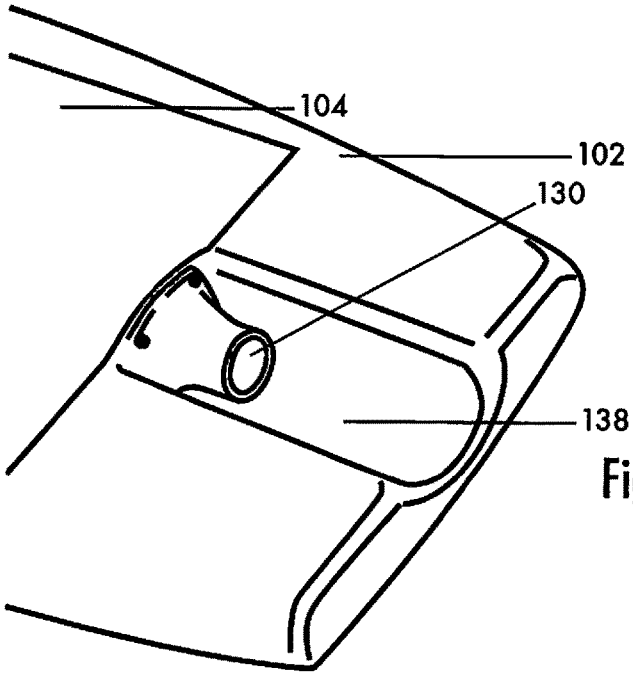
FIG. 10*a* is a top perspective view of the top rear section of the water propulsion boards shown in FIG. 1 showing the water propulsion nozzle and the water jet channel in the upper surface of the water propulsion board.
Figure 10B:
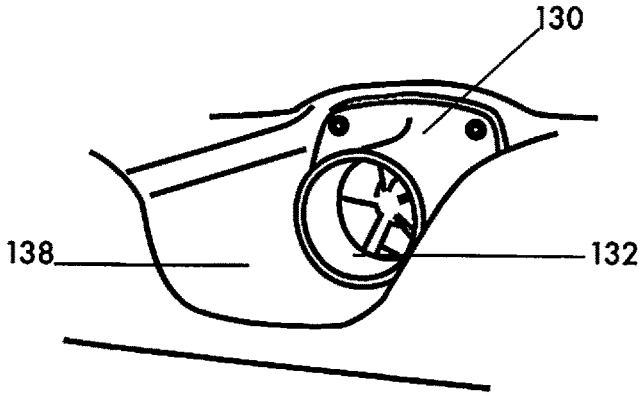
FIG. 10*b* is another perspective view of the water propulsion nozzle and water jet channel shown in FIG. 10*a* in the top section of the board.

In an alternative embodiment shown in FIG. 8, the motorized water propulsion board is approximately 8 to approximately 9 feet in length, approximately 22 to approximately 26 inches in width with a different thickness at the tail of the board than at the nose of the board as shown in FIG. 10*b*. In this embodiment, the board has a minimum thickness of approximately 3.5 inches at the tail of the board, a thickness of approximately greater than 3 inches at the center of the board, and a weight of approximately 21 to approximately 25 lbs without the rechargeable battery installed. In this alternative embodiment, the board is primarily used for recreation.

As shown in FIG. 1, the water rescue board upper surface (deck) includes holding straps 140 along both sides of the water rescue board to assist the victim in climbing onto the board and to hang on while being returned to shore or to assist the lifesaver in getting the victim on the water rescue board. Holding straps can be included for the lifeguard separate from the victim holding straps as shown, or the holding straps can be a continuous series of hand straps along both sides of the board. In a preferred embodiment, the straps are removeably attached to the upper surface of the board.

Figure 9:
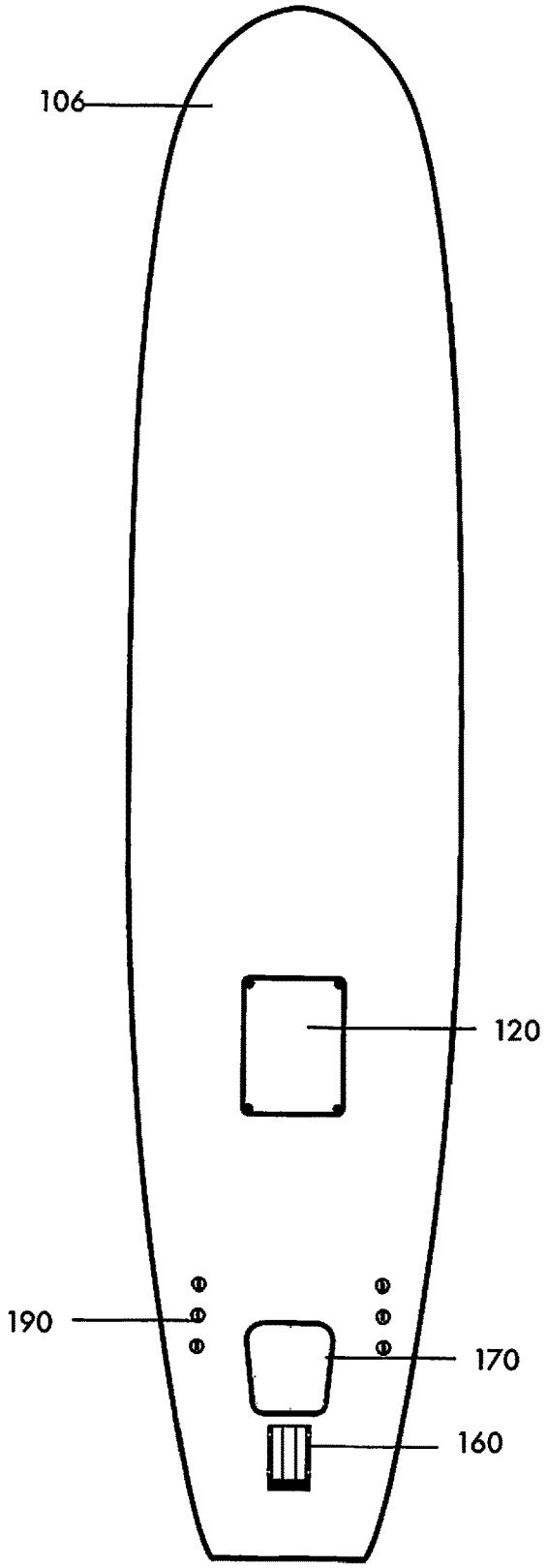
FIG. 9 is a bottom view of the motorized water propulsion water recreation board according to another embodiment of the present invention.

The top surface also includes a watertight battery access panel 120 that covers an internally stored extractable and rechargeable D.C. battery pack. The interior side of the battery access panel 120 includes a channel for a gasket so that when the battery access panel 120 is properly installed, the battery compartment is watertight. When the deck of the water rescue board is covered with a pad, a mating pad is applied to the outer surface of the battery access panel 120 to form a continuous pad surface on the deck. In the alternative 8 to 9 foot motorized water propulsion board, the battery compartment is located on the bottom surface of the board as shown in FIG. 9. When properly installed, the battery access cover 120 to form a substantially flat bottom surface.

Figure 3A:
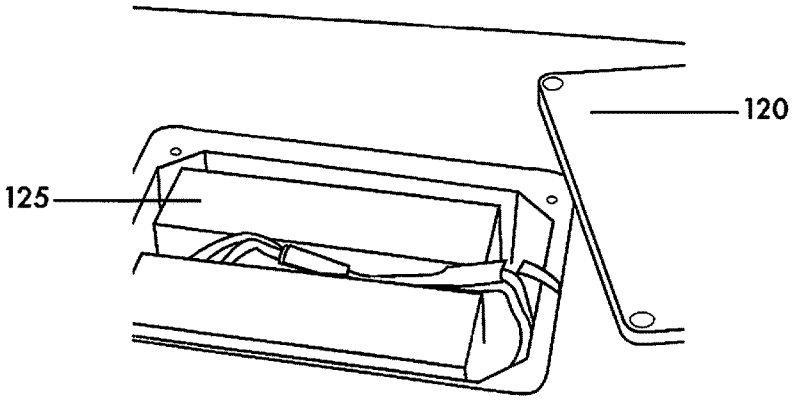
FIGS. 3*a*, 3*b* and 3*c* show the battery compartment housing a battery, the removable battery compartment cover being fastened into the board, and the battery cover installed, respectively.
Figure 3B:
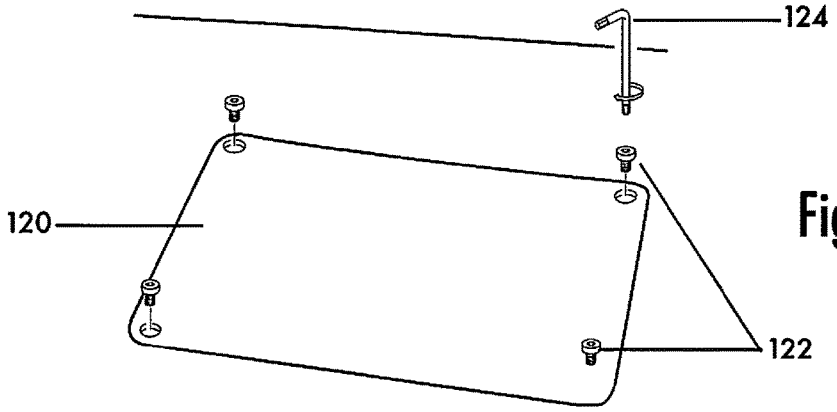
Figure 3C:
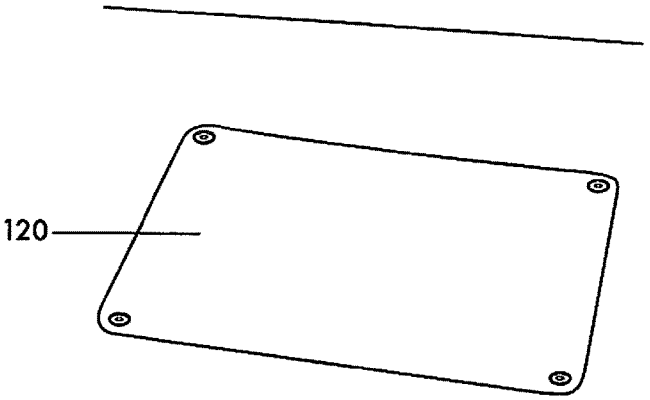

FIG. 3*a* shows the battery compartment housing a battery 125 within the body of the water rescue board. The removable battery compartment cover 120 is removable for recharging or replacing the batteries. When recharge is necessary, the battery compartment cover 120 is removed as shown in FIG. 3*b* and the batteries are removed for charging, with a standard charging device. As shown in FIG. 3*b*, the battery access cover can be fastened into the top side (or bottom side) of the board with a common allen tool and when the battery access cover 120 installed correctly, the battery access cover is at the same height as the deck or the bottom of the water rescue board as shown in FIG. 3*c*.

Figure 5A:
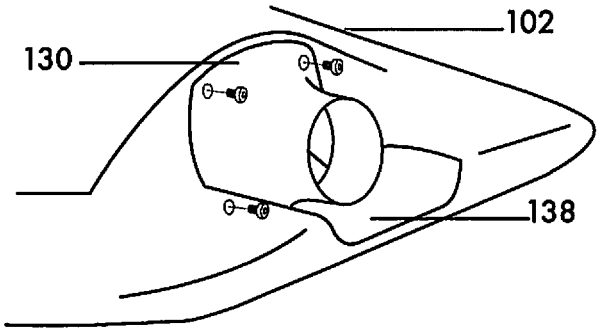
FIG. 5*a* shows the water propulsion nozzle installed on the upper rear portion of the board.

The upper surface of the tail of the board is shaped to accommodate the jet outlet 130 as shown in FIG. 5*a* and FIG. 10*a*. To accommodate the jet outlet 130, the upper surface of the tail has a protrusion in the upper surface of the water rescue board 100 tail section. An advantage of the protrusion is that the lifeguard or other water rescue personnel can feel where the deck of the water rescue board ends and jet outlet begins to prevent the user from accidentally stepping into the jet outlet stream during operation.

Figure 11:
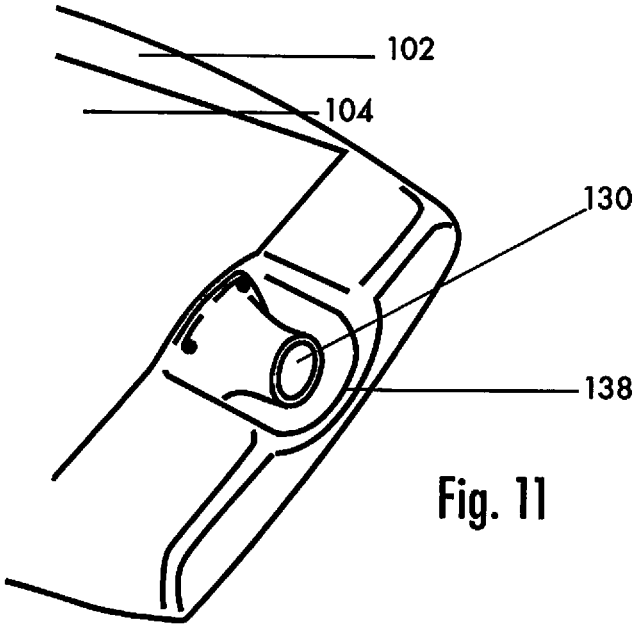
FIG. 11 is a top perspective view of the top rear section of the water propulsion boards shown in FIG. 8 showing the water propulsion nozzle and the water jet channel in the upper surface of the water propulsion board.

In the alternative 8 to 9 foot motorized water propulsion board, the upper surface of the tail of the board is also shaped to accommodate the water propulsion system. FIG. 11 is a top perspective view of the motorized 8 to 9 foot water propulsion water recreation board showing the protusion in the upper surface of the board for the water propulsion system and particularly, the water propulsion nozzle 130 at the tail of board. As shown, the surface of the board is smooth, however the tail has a water jet channel 138 at the tail of the board as shown in FIG. 10*a* and in FIG. 11 while the upper and bottom surface are substantially flat at the nose of the board as shown in FIG. 1 and FIG. 8.

Figure 2:
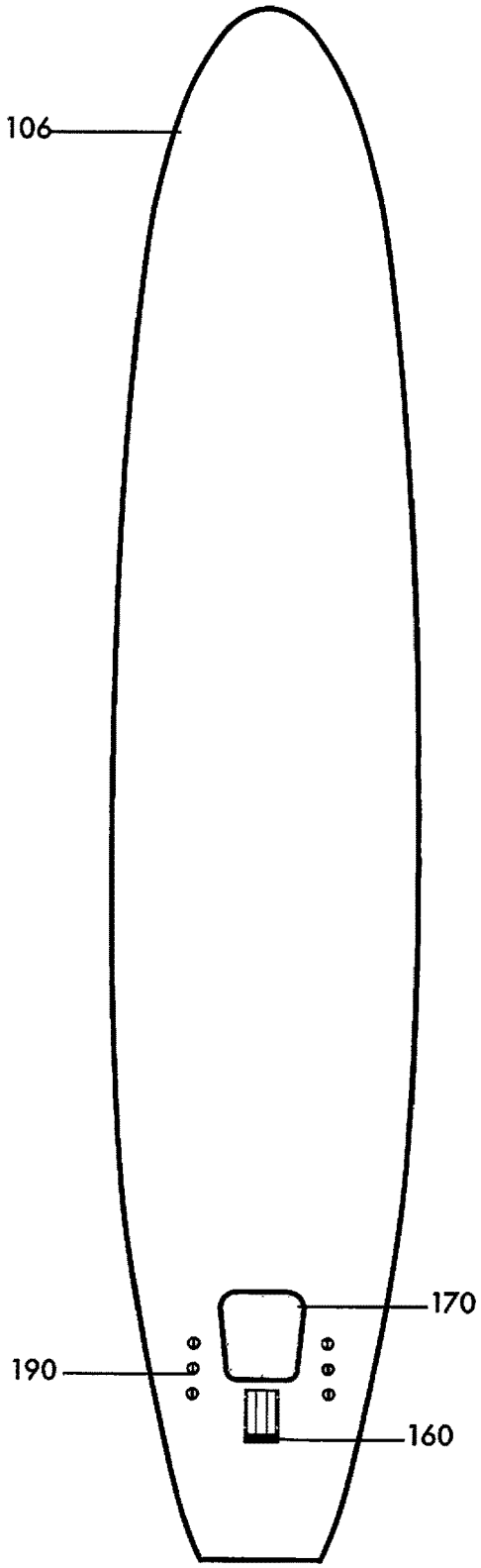
FIG. 2 is a bottom view of the water propulsion water rescue board according to an embodiment of the present invention.

FIGS. 2 and 9 are bottom views of the water propulsion board 100 showing the water inlet grid 160, motor compartment cover 170 and attachment points 190 for one or more fins (not shown), one in the example shown in FIG. 2 and 2 fins in the alternative configuration shown in FIG. 9. Fins are used for stabilizing and steering the board and an alternative number of fins can be designed into the board for different purposes. The water propulsion water rescue board can have one single fin or up to 5 fins and the fins can be of different sizes.

Figure 4A:
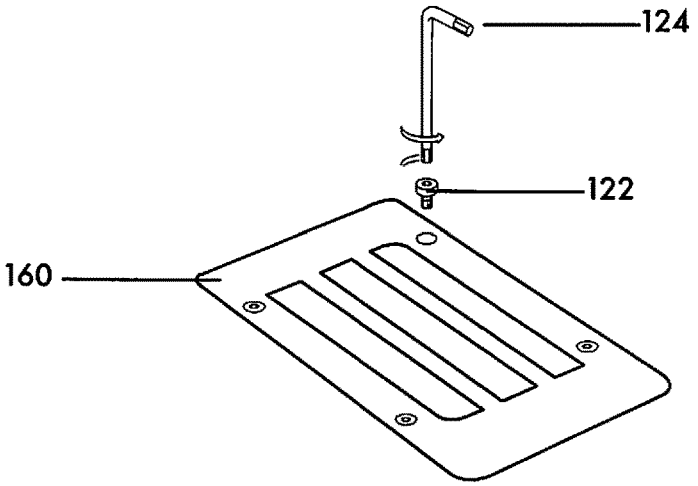
FIGS. 4*a*, 4*b* and 4*c* show the removable water inlet cover, removal of the water inlet cover and removal of debris from the water inlet, respectively.

The grid 160 on the water inlet allows maximum water flow to enter while blocking most foreign debris from entering that could cause damage or block the intake of water. During operation, debris may be drawn into the water inlet. To provide maximum thrust, the debris can be manually removed after power has been removed from the propulsion system. As shown in FIG. 4*a*, the inlet cover 160 includes a grid to block large debris and is fastened in place with fasteners 122 using a fastening tool 124. While the fastening tool 124 shown is an allen tool in FIG. 4*a*, alternative tools such as a screwdriver can be substituted. In a preferred embodiment, the fastener is a stainless steel screw.

Figure 4B:
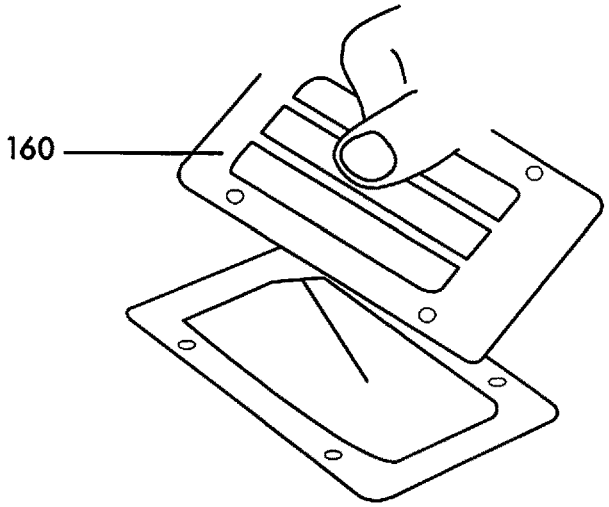
Figure 4C:
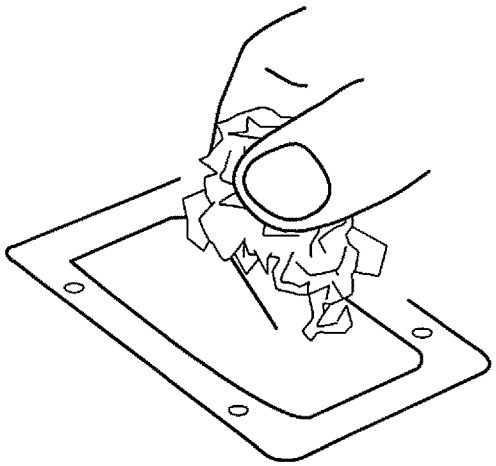

Once the water inlet grid 160 is removed as shown in FIG. 4*b*, debris can be manually removed as shown in FIG. 4*c*. Like the battery compartment access cover 120, the fasteners for the water inlet grid cover 160 are tightened until the cover is flush with the bottom of the water rescue board after the debris has been removed.

When the user elects to use the water propulsion board for recreation, the battery can be removed to reduce weight and the water intake grid can be replaced with a flat cover to substantially block water from entering the water intake.

The bottom of the water rescue board 100 of the alternative 8 to 9 foot board also include an motor access cover 170 to provide access the motor compartment. The motor compartment is waterproof and cooled, and contains the electric motor and the motor management controller coupled with the control panel 150. In a preferred embodiment, the motor is oil cooled, such as synthetic oil cooled. The battery driven motor drives the propeller to draw water in and creates a column of water that exits the jet nozzle 130 thrusting the water rescue board forward. The motor management system includes a temperature sensor coupled with the motor compartment for monitoring the temperature of the motor compartment.

Figure 5B:
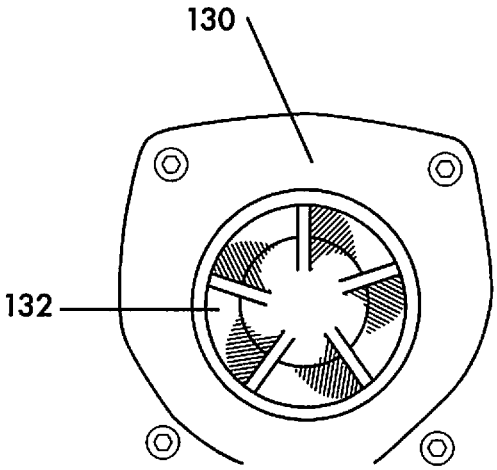
FIG. 5*b* shows the vane within the water propulsion nozzle.
Figure 6:
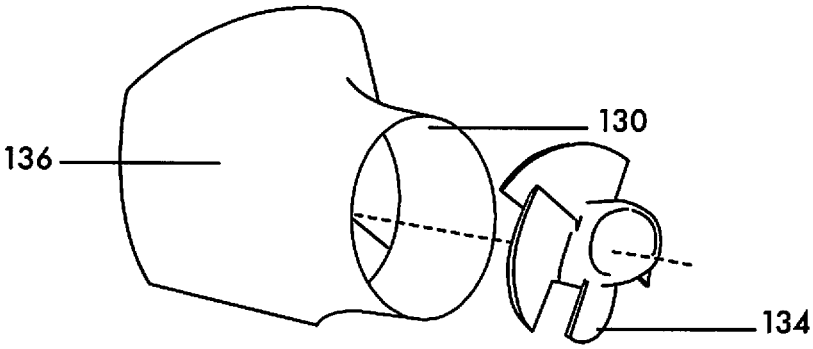
FIG. 6 shows the propeller that is assembled with the water propulsion nozzle.
Figure 10C:
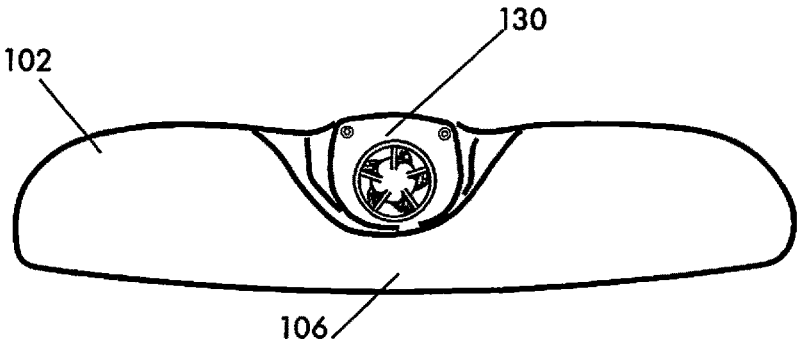
FIG. 10*c* is a rear view of the tail section of the water propulsion boards shown in FIG. 1 and FIG. 8.

FIGS. 5*a* and 10*a* show the water propulsion nozzle 130 installed on the upper tail section of the water rescue board 100 as previously described. The water propulsion water rescue boards are propelled by an electro-mechanical system consisting of an electric motor or engine turning a propeller 134. The nozzle 130 allows water to thrust outward for propulsion and contains a vane to optimize the flow and enhance the thrust. FIG. 5*b* shows the vanes 132 within the water propulsion nozzle 130. The nozzle 130 is removable for servicing and for removal of debris drawn in through the water inlet grid 160 on the bottom of the water propulsion water rescue board 100. The water propulsion nozzle body 136 shown in FIG. 5*b* includes vanes 132. Propeller blades 134 are located between the nozzle vanes 132 and nozzle 130. FIG. 6 shows how the propeller that is integrated between the water inlet and the water propulsion nozzle 130. FIG. 10*c* is a rear view of the water propulsion board showing the water jet channel 138 in the tail of the board to allow the column of water exiting the propulsion nozzle to thrust the board forward.

When the water propulsion boards are in the water, the battery powered motor drives the propeller's leading side, the suction side, to draw water in through the water inlet 160 on the bottom of the board pulling itself through the water by creating a vacuum. As the water is drawn into the water propulsion system by the propeller, the propeller accelerates the water flow backward, creating a high overpressure, forcing the water outward through the nozzle 130 thrusting the board forward. The propeller blades suction and pressure effect starts the water to move, and forces it away creating a column of water behind it which discharges through the water propulsion nozzle 130.

Figure 7:
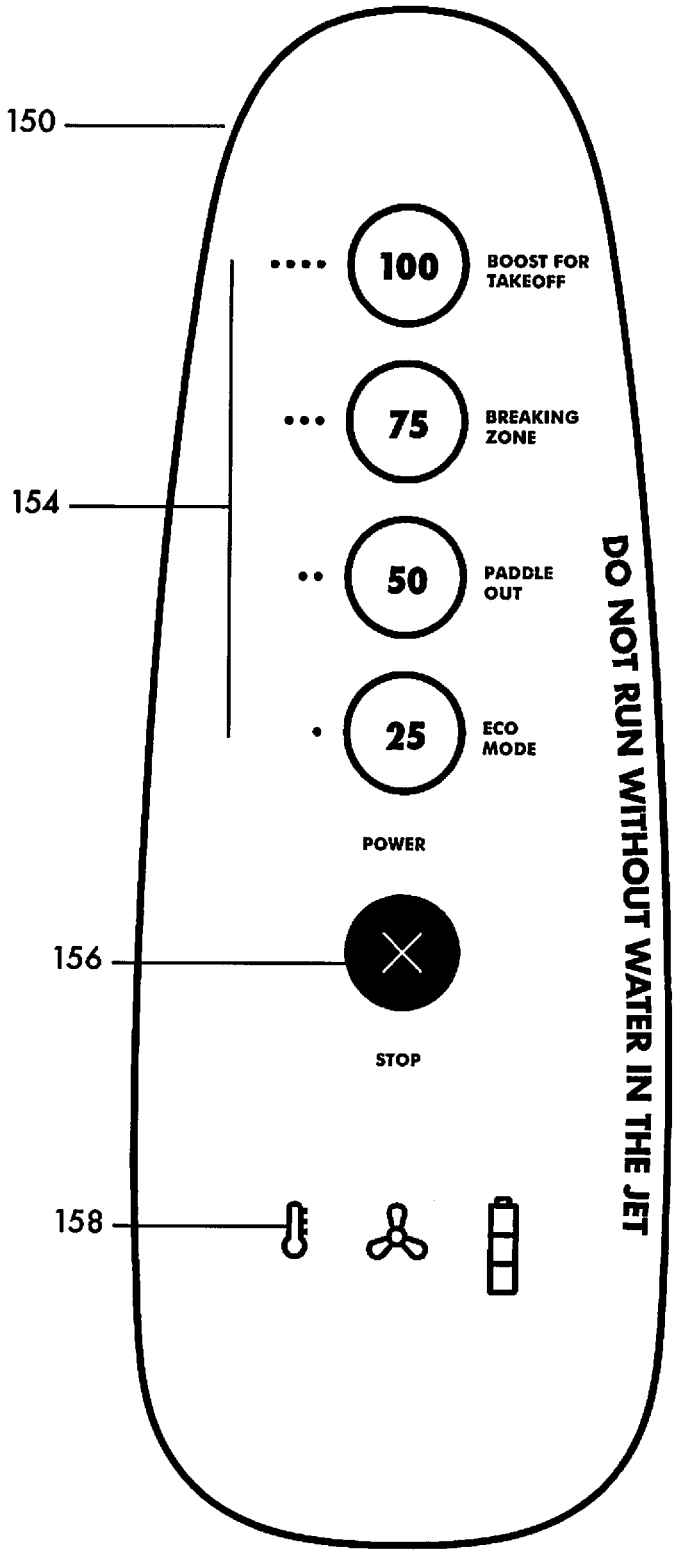
FIG. 7 shows an example of an electronic control panel.

The water propulsion water rescue board includes a control panel 150 on the upper side rail of the board as shown on the right side rail in FIG. 1 and on the deck as shown in FIG. 8. FIG. 7 shows an example of an electronic control panel 150. The water propulsion system control panel includes a power/stop button 154 to stop the motor when the user wants to paddle manually or remain in a waiting position, thus reserving battery power until needed.

In the example shown in FIG. 7, the control panel includes four different preset thrust levels 154 for the jet to reach the propulsion level needed for each phase of the rescue maneuver. However, an alternative number of thrust level, such as two for High and Low, can be substituted.

The four power levels, or modes of operation shown include a boost mode that provides full (approximately 100%) power for takeoff, a breaking zone mode using approximately seventy-five percent power, a paddle out mode with approximately fifty percent thrust to assist in paddling out to the victim and an ECO mode using only approximately twenty-five percent power to conserve battery life. The control panel 150 can also include one or more indicators 158 for temperature, propeller obstruction and battery status as shown in FIG. 7.

When there is overheating due to motor overuse on high power, a temperature sensor produces a signal for the control management to illuminate the temperature indicator and to stop the motor. When the motor cools down, the indicator goes off and the power can be switched back on.

The water propulsion jet is protected with a grid to keep debris out to prevent or minimize obstruction of the water propulsion jet. Both the design and distances have been optimized to avoid or minimize this problem. A flow sensor is coupled to detect an obstruction in the water propulsion system. When debris is detected, the propeller indicator is illuminates and if the obstruction is serious, the propulsion system switches off.

The battery status can show three different colors indicating three different battery capacity levels such as green, yellow and red.

Those skilled in the art will appreciate that the above-described principles could be applied to other water bottle designs to realize the advantages of the present invention. Those skilled in the art will also appreciate variations of the above described embodiments that fall within the scope of the invention. As a result, the invention is not limited to the specific examples and illustrations discussed above, but only by the following claims and their equivalents.

I claim:

1. A water propulsion water rescue board comprising:

a body with an upper surface and a bottom surface, a length between nine feet and eleven feet between a nose and a tail, and a thickness between 3.5 inches and 6 inches;

a water propulsion system integrated into the body including a water inlet on the bottom surface of the body, a water propulsion nozzle and a water jet channel on the upper tail surface, and a propeller between the water inlet and the water propulsion nozzle, wherein the water propulsion nozzle includes vanes between the propeller and the water propulsion nozzle to optimize water flow and increase thrust;

an electric motor connected to rotate the propeller for drawing water into the propulsion system through the water inlet and expelling a pressurized column of water through the water propulsion nozzle from the upper surface of the body;

a removable rechargeable battery connected with the electric motor; and a controller powered by the rechargeable battery within the body with a user control pad on the upper surface of the body for motor management to allow the user to control the operation of the water propulsion system.

2. The water propulsion water rescue board of claim 1, the body having a volume of at least 5 cubic feet to provide a volume rigidity to transport at least two adults.

3. The water propulsion water rescue board of claim 1, wherein the body is approximately 10 foot and 2 inch in length with a thickness of at least 3.5 inches.

4. The water propulsion water rescue board of claim 3, wherein the body has a width of 22 inches to 26 inches.

5. The water propulsion water rescue board of claim 1, wherein the weight of the water propulsion water rescue board is between 22 lbs and 30 lbs without the removable battery installed.

6. The water propulsion water rescue board of claim 1, further comprising a removable battery access cover on the upper surface of the body for removing the rechargeable battery.

7. The water propulsion water rescue board of claim 1, wherein the water inlet on the bottom surface of the body includes a removable grid cover to prevent large debris from entering the water inlet and for manually removing debris drawn into the water inlet.

8. The water propulsion water rescue board of claim 1, further comprising at least one fin removably attached to the bottom tail of the water propulsion water rescue board.

9. A water propulsion water rescue board comprising:

a body with an upper surface and a bottom surface, a length between nine feet and eleven feet between a nose and a tail, and a thickness between 3.5 inches and 6 inches;

a water propulsion system integrated into the body including a water inlet on the bottom surface of the body, a water propulsion nozzle and a water jet channel on the upper tail surface, and a propeller between the water inlet and the water propulsion nozzle;

an electric motor connected to rotate the propeller for drawing water into the propulsion system through the water inlet and expelling a pressurized column of water through the water propulsion nozzle from the upper surface of the body;

a removable rechargeable battery connected with the electric motor; and a controller powered by the rechargeable battery within the body with a user control pad on the upper surface of the body for motor management to allow the user to control the operation of the water propulsion system, wherein the user control pad includes at least two different selectable thrust levels.

10. The water propulsion water rescue board of claim 9, wherein the control pad includes a stop button.

11. The water propulsion water rescue board of claim 9, wherein the control pad includes four 4 different selectable thrust levels.

12. The water propulsion water rescue board of claim 9, wherein the control pad includes at least one indicator to display a propulsion system operation.

13. The water propulsion water rescue board of claim 12, further including a motor temperature sensor coupled with the controller to illuminate a temperature indicator on the control pad and to stop the electric motor when an overheating is detected.

14. The water propulsion water rescue board of claim 12, further including a battery indicator for displaying up to three different battery capacity levels.

15. The water propulsion water rescue board of claim 12, further including a flow sensor coupled to detect an obstruction in the water propulsion system and illuminate a propeller indicator and to switch the propeller off when a preselected minimum flow is detected.

16. The water propulsion water rescue board of claim 1, wherein the length of the board is 8 to 9 feet with the thickness being greater than 3 inches at the nose and greater than 3.5 inches at the tail.

17. The water propulsion water rescue board of claim 16, further comprising a removable battery access cover on the bottom surface of the body for removing the rechargeable battery.

18. The water propulsion water rescue board of claim 16, further comprising at least two fins removably attached to the bottom tail of the water propulsion water rescue board.

* * * * *